US005202910A

United States Patent [19]

Ausburn et al.

[11] Patent Number: 5,202,910

[45] Date of Patent: Apr. 13, 1993

[54] ANODE FOR ARC DISCHARGE DEVICES

[75] Inventors: Phillip K. Ausburn, Lawrenceville; Loyce A. Turner, SE. Smyrna, both of Ga.

[73] Assignee: North American Philips Corporation, New York, N.Y.

[21] Appl. No.: 902,770

[22] Filed: Jun. 23, 1992

Related U.S. Application Data

[63] Continuation of Ser. No. 574,620, Aug. 28, 1990.

[51] Int. Cl.[5] ..... H01J 35/22

[52] U.S. Cl. ..... 378/121; 378/119; 378/127

[58] Field of Search ..... 378/121, 126, 139, 128, 378/119, 127, 137, 138, 142, 141; 313/359.1

[56] References Cited

U.S. PATENT DOCUMENTS

| | | | |
|---|---|---|---|
| 3,662,210 | 5/1972 | Maximov | 378/143 |
| 3,783,288 | 1/1974 | Babour et al. | 378/106 |
| 3,814,974 | 6/1974 | Basiulis | 313/240 |
| 3,970,892 | 7/1976 | Wakalopulos | 315/111.31 |
| 4,749,912 | 6/1988 | Hara et al. | 313/359.1 |
| 4,864,191 | 9/1989 | Van De Weijer | 313/633 |
| 4,955,045 | 9/1990 | Friede et al. | 378/122 |

FOREIGN PATENT DOCUMENTS 0168777 2/1989 European Pat. Off. .

OTHER PUBLICATIONS

Soviet Inventions Illustrated, Section Ch, Week 7249, Oct. 1972 Derwent Publications Ltd., London, GB; Class M, p. 30, An 72-77985T/49 & SU-A-334 270 High Metals and Hard Alloys, Res. Inst.) May 6 1972-Abstract.

H. Cross Co., "Precision Metal Rolling" (Weehawken NJ) Sections on Rhenum and Rhenuim Alloys and Molybdenum, H. Cross Co., "Rolling Your Way", Pamphlet.

Defense Technical Info Center, "High Voltage Breakdown Study" by Mulcahy et al (1971).

*Primary Examiner*—Constantine Hannaher
*Assistant Examiner*—Don Wong
*Attorney, Agent, or Firm*—Anne E. Barschall

[57] ABSTRACT

Improved materials for the electrodes of arc discharge devices reduce arcing damage.

The materials have a ductile-to-brittle transition temperature at or below the normal operating temperature of the devices.

14 Claims, 1 Drawing Sheet

ANODE FOR ARC DISCHARGE DEVICES

This is a continuation of application Ser. No. 07/574,620, filed Aug. 28, 1990.

BACKGROUND OF THE INVENTION

1. Field of the Invention

The invention relates to the field of arc discharge devices, and in particular to x-ray tubes. More specifically, the invention relates to materials for anodes for such devices.

2. Related Art

Relevant portions of a conventional X-ray tube are illustrated in FIG. 1. For simplicity, various other portions of a conventional tube, such as seals, external materials, and magnet are not illustrated. The tube has a cathode 101, a filament 102 within the cathode 101, an accelerating anode 103, a drift tube 104 and a target anode 105. Electrons burning off the filament 102 are accelerated through the accelerating anode 103, drift through the drift tube 104 to strike the target anode 105. As a consequence, the target anode produces x-rays 106. The minimum voltage needed to achieve the preferred current varies as a function of the distance d 107 between the cathode 101 and the accelerating anode 103.

It is desirable to minimize the minimum voltage required. However, when the distance d 107 becomes too small, a high current arc discharge develops between the cathode 101 and the accelerating anode 103. Such discharges eventually can destroy the accelerating anode.

Another prior art high current arc discharge device is a high voltage vacuum switch. These are used at substations of power transmission lines. These switches often develop arcing between metal contacts when switches are closed or opened.

Another prior art high current arc discharge device is a spark gap. These devices break down in response to a critical voltage in order to arrest high voltage discharges. The spark gap breaks down by arcing. A similar device is the triggered spark gap which breaks down in response to a trigger rather than in response to a high voltage discharge.

It is desirable in all of these devices to decrease arcing damage in the anodes, or electrodes acting as anodes, in order to increase the lives of the devices. If such arcing damage is reduced the distance between electrodes can be reduced. As a result, a greater range of electric field intensities can be used, and the size of the devices can be reduced. For instance the distance d 107 can be reduced.

To reduce arcing damage in high current arc discharge devices, the anodes, or electrodes acting as anodes, have traditionally been made of materials which maximize the product of melting point, specific heat and density. Traditionally this maximum was achieved with tungsten.

To reduce chemical damage in light bulb electrodes, a tungsten/rhenium alloy with small amounts of rhenium has been used, see e.g. U.S. Pat. No. 4,864,191.

To reduce mechanical damage in target anodes of x-ray tubes, tungsten/rhenium alloys have been used, see e.g. H. Cross Co., "Rhenium and Rhenium Alloys", (Weehawken N.J. 07087). It is noted that target anodes in x-ray tubes are not exposed to high current arc discharge, unlike the accelerating anodes.

SUMMARY OF THE INVENTION

It has now been discovered that exposing tungsten to high current arc discharges causes not only melting, but principally causes splintering as a result of sudden heating. This is splintering is attributed to the high ductile-to-brittle transition temperature of tungsten.

It is an object of the invention to decrease this arcing damage.

To achieve this object the invention uses for the anode, or the electrode acting as anode, a material which has a ductile-to-brittle transition temperature at or below the normal operating temperature of the device, in addition to having a high product of melting point, specific heat, and density.

DETAILED DESCRIPTION OF THE PREFERRED EMBODIMENTS

Figure 1:
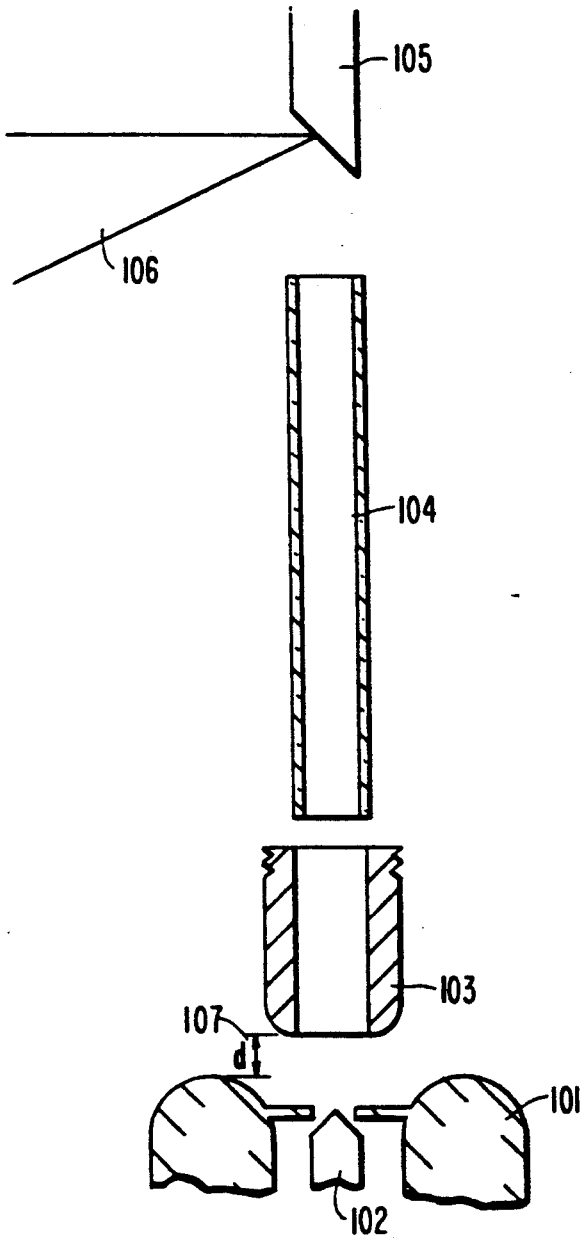
FIG. 1 is a cross-section of an x-ray tube.

In all of the arc discharge devices, any electrode which acts as an anode should be made of a material which has a ductile-to-brittle temperature at or below the operating temperature of the device. The material should also come as close as possible to maximizing the product of melting point, specific heat, and density, within the constraint on ductile-to-brittle temperature.

The normal operating temperature for the x-ray tube is room temperature, or about 27° C., while the ductile-to-brittle transition temperature of tungsten is about 1200° C. Thus, while tungsten maximizes the product of melting point, specific heat, and density, it is not optimal as a material for the accelerating anode of the x-ray tube. Molybdenum, tantalum, and rhenium have been shown to be desirable for the accelerating anode, because their ductile-to-brittle transition temperature is below room temperature and the product of their melting point, specific heat, and density approaches that of tungsten. Rhenium has a ductile-to-brittle transition temperature of approximately 0° K. Molybdenum and tantalum have ductile-to-brittle transition temperatures below room temperature. Of these materials molybdenum is preferred, because it is easier to machine than rhenium or tantalum.

Other high current arc discharge devices should use materials which similarly have ductile-to-brittle temperatures at or below their normal operating temperatures, and a product of melting point, specific heat and density which is as high as possible, within the first constraint.

We claim:

1. A device comprising:

a) a first electrode acting as a cathode; and b) a second electrode acting as an anode exposed to high current arc discharges;

wherein the improvement comprises that the second electrode is made of a material which has a ductile-to-brittle transition temperature at or below the normal operating temperature of the device, whereby mechanical splintering damage to the second electrode, from sudden heating due to arcing, is reduced.

2. The device of claim 1, wherein the material is a metal.

3. The device of claim 2, wherein the device is an x-ray tube, and the second electrode is an accelerating anode.

4. The device of claim 3, wherein the material comprises molybdenum.

5. The device of claim 3, wherein the material comprises tantalum.

6. The device of claim 3, wherein the material comprises rhenium.

7. The device of claim 2, wherein a) the device is a high voltage vacuum switch; and b) both the first and second electrodes are made of the material.

8. The device of claim 2, wherein the device is a spark gap.

9. The device of claim 2, wherein the device is a triggered spark gap.

10. The device of claim 2, wherein the material has a product of melting point, specific heat, and density which is as high as possible, given the ductile-to-brittle transition temperature.

11. The device of claim 2, wherein the material consists essentially of molybdenum.

12. The device of claim 2, wherein the material consists essentially of tantalum.

13. The device of claim 2, wherein the material consists essentially of rhenium.

14. The device of claim 1 wherein the normal operating temperature of the device is approximately 27° C.

* * * * *